US011318749B2

(12) United States Patent
Koizumi et al.

(10) Patent No.: US 11,318,749 B2
(45) Date of Patent: May 3, 2022

(54) INK CARTRIDGE, PRINTER, AND METHOD FOR MOUNTING INK CARTRIDGE

(71) Applicant: SEIKO EPSON CORPORATION, Tokyo (JP)

(72) Inventors: Yoshihiro Koizumi, Shiojiri (JP); Tadahiro Mizutani, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 14 days.

(21) Appl. No.: 17/131,991

(22) Filed: Dec. 23, 2020

(65) Prior Publication Data

US 2021/0197575 A1 Jul. 1, 2021

(30) Foreign Application Priority Data

Dec. 25, 2019 (JP) ..... JP2019-234109

(51) Int. Cl.
*B41J 2/175* (2006.01)

(52) U.S. Cl.
CPC ..... *B41J 2/17523* (2013.01); *B41J 2/17553* (2013.01)

(58) Field of Classification Search
CPC .. B41J 2/17523; B41J 2/17553; B41J 2/1752; B41J 2/1755
See application file for complete search history.

(56) References Cited

U.S. PATENT DOCUMENTS

2020/0282729 A1 9/2020 Inoue et al.

FOREIGN PATENT DOCUMENTS

JP 2019-073014 A 5/2019
WO WO-2019074132 A1 * 4/2019 ..... B41J 2/16517

* cited by examiner

*Primary Examiner* — Bradley W Thies
(74) *Attorney, Agent, or Firm* — Oliff PLC

(57) ABSTRACT

In a state in which a cartridge body is not inserted in a cartridge receiving section provided on a printer side, an electronic component mounting section is held at an initial position to the cartridge body. The cartridge body is linearly inserted into the cartridge receiving section of the printer along a first direction, which is an insertion direction of the cartridge body, to a second position before a first position in which the cartridge body is in a mounted state in the cartridge receiving section. By the cartridge body being linearly inserted from the second position to the first position along the first direction, the electronic component mounting section is moved from the initial position in a second direction different from the first direction to couple the electronic component to electrical coupling portions provided on the printer side.

6 Claims, 9 Drawing Sheets

INK CARTRIDGE, PRINTER, AND METHOD FOR MOUNTING INK CARTRIDGE

The present application is based on, and claims priority from JP Application Serial Number 2019-234109, filed Dec. 25, 2019, the disclosure of which is hereby incorporated by reference herein in its entirety.

BACKGROUND

1. Technical Field

The present disclosure relates to an ink cartridge, a printer in which an ink cartridge is mounted, and a method for mounting an ink cartridge.

2. Related Art

As an ink cartridge that is mounted in a printer and supplies ink to the printer, as described in JP-A-2019-73014, there is known an ink cartridge that is not simply pushed into a mounting portion of a printer when being mounted in the printer, but is further rotated to be mounted. The purpose of rotating the ink cartridge is to separate an action of bringing pad electrodes provided on an ink cartridge side into contact with electrical coupling portions on a printer side from an insertion action of mounting the ink cartridge in the printer. It has been pointed out that, when attempting to complete the mounting and electrical coupling of the ink cartridge just by pushing the ink cartridge, in a case in which the force for pushing the ink cartridge is too strong, there may be a problem in electrical contact.

However, in the ink cartridge having such a structure, after pushing the ink cartridge into the printer, the user has to rotate the ink cartridge further, which causes various problems. First, the user is required to perform the two different actions when mounting the ink cartridge, which is not convenient for mounting the ink cartridge. In addition, as it is not clear how much to rotate the ink cartridge, it is conceivable that the electrical coupling may not be made or may be insufficient due to insufficient rotation. Further, when a used ink cartridge is removed and replaced, the used ink cartridge needs to be rotated in the opposite direction before being pulled out, but the printer or the ink cartridge may be damaged by pulling the ink cartridge with excessive force without noticing that the rotation action is required.

SUMMARY

The present disclosure can be achieved as the following aspects or applications.

A first aspect of the present disclosure is an aspect as an ink cartridge which is mounted in a printer. The ink cartridge includes a cartridge body configured to contain ink to be supplied to the printer, including a guide portion having a shape that fits into a cartridge receiving section provided on a printer side, and configured to be linearly inserted to a first position in which the ink cartridge is in a mounted state in the cartridge receiving section, an electronic component mounting section configured to mount an electronic component, and configured to move with respect to the cartridge body in a second direction different from a first direction that is a direction in which the ink cartridge is inserted into the cartridge receiving section, a holding portion configured to hold the electronic component mounting section at an initial position in which the electronic component mounting section is in a predetermined positional relationship with the cartridge body when the cartridge body is not inserted into the cartridge receiving section, and a moving portion, by the cartridge body being inserted in the first direction from a second position before the first position in the cartridge receiving section of the printer, configured to move the electronic component mounting section in the second direction from the initial position to couple the electronic component to electrical coupling portions provided on the printer side.

A second aspect is an aspect as a printer including a printer body and an ink cartridge which is mounted in the printer body. The printer body of the printer includes a cartridge receiving section for receiving the ink cartridge, an engaging portion formed on an inner surface of the cartridge receiving section, electrical coupling portions provided on the inner surface of the cartridge receiving section, and an electronic circuit coupled to the electrical coupling portions. On the other hand, the ink cartridge may include a cartridge body configured to contain ink to be supplied to the printer body, including a guide portion having a shape that fits into the cartridge receiving section of the printer body, and configured to be linearly inserted to a first position in which the ink cartridge is in a mounted state in the cartridge receiving section, an electronic component mounting section configured to mount an electronic component, and configured to move with respect to the cartridge body in a second direction different from a first direction that is a direction in which the ink cartridge is inserted into the cartridge receiving section, a holding portion configured to hold the electronic component mounting section at an initial position in which the electronic component mounting section is in a predetermined positional relationship with the cartridge body when the cartridge body is not inserted into the cartridge receiving section, an engaged portion provided on an outer periphery of the cartridge body, and configured to move the electronic component mounting section in the second direction from the initial position by engaging with the engaging portion of the printer body and by the cartridge body being inserted in the first direction from a second position before the first position in the cartridge receiving section of the printer body, and coupling bodies configured to couple the electronic component to the electronic circuit of the printer body by coupling to the electrical coupling portions of the printer body with the movement of the electronic component mounting section in the second direction.

A third aspect is an aspect as a method for mounting, in a printer, an ink cartridge including a cartridge body containing ink and an electronic component mounting section on which an electronic component is mounted. This mounting method includes holding the electronic component mounting section at an initial position that is a predetermined position to the cartridge body in a state in which the cartridge body is not inserted in a cartridge receiving section provided on a printer side, linearly inserting, in the cartridge receiving section of the printer, the cartridge body including a guide portion having a shape that fits into the cartridge receiving section along a first direction, which is an insertion direction of the cartridge body into the cartridge receiving section, to a second position before a first position in which the cartridge body is in a mounted state in the cartridge receiving section, and moving the electronic component mounting section from the initial position in a second direction different from the first direction to couple the electronic component to electrical coupling portions provided on the printer side, by linearly inserting the cartridge body from the second position to the first position along the first direction.

DESCRIPTION OF EXEMPLARY EMBODIMENTS

A. First Embodiment

1. Configuration of Printer and Ink Cartridge Receiving Section

Figure 1:
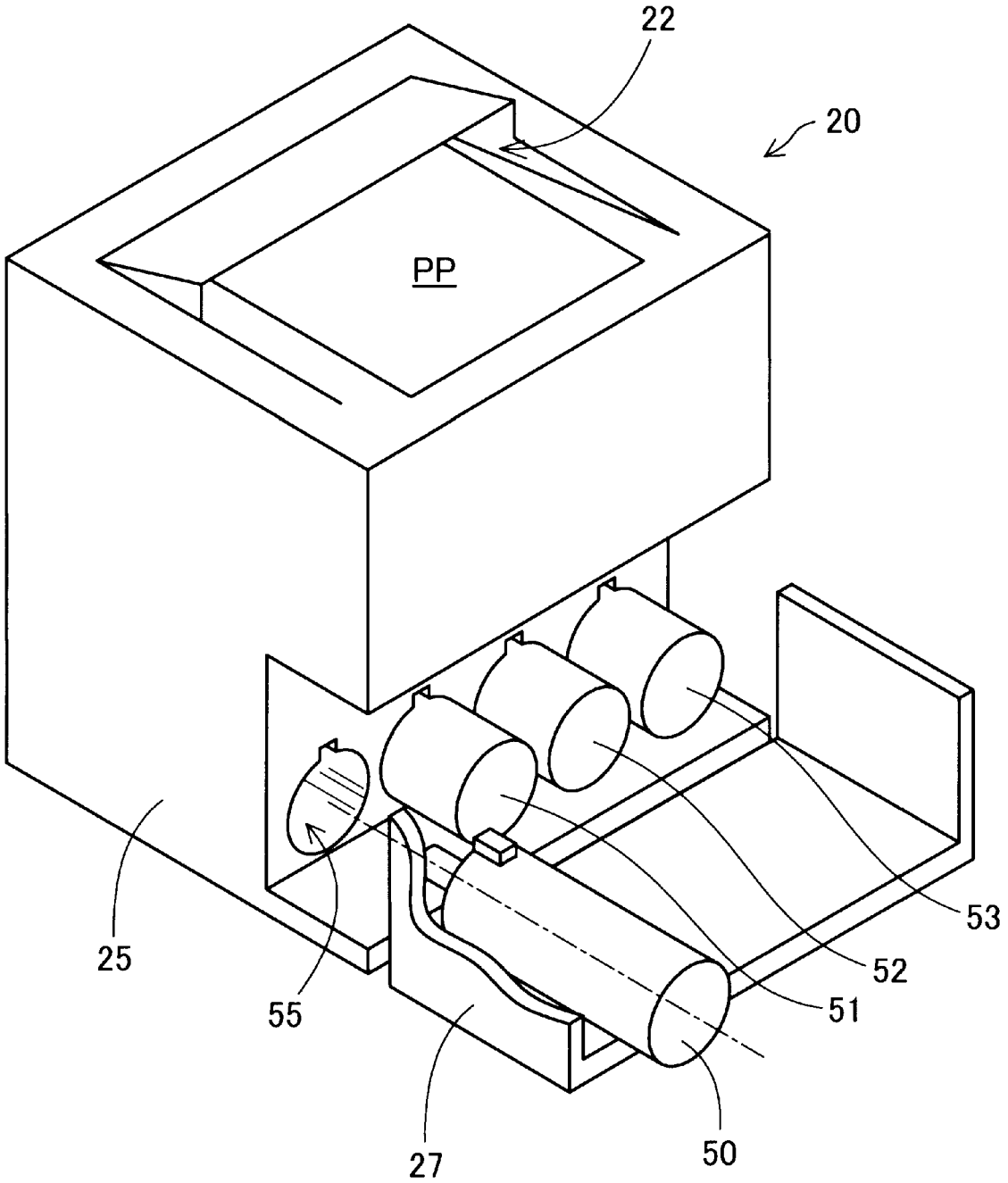
FIG. 1 is an external view of a printer in which an ink cartridge of an embodiment is mounted.
Figure 2:
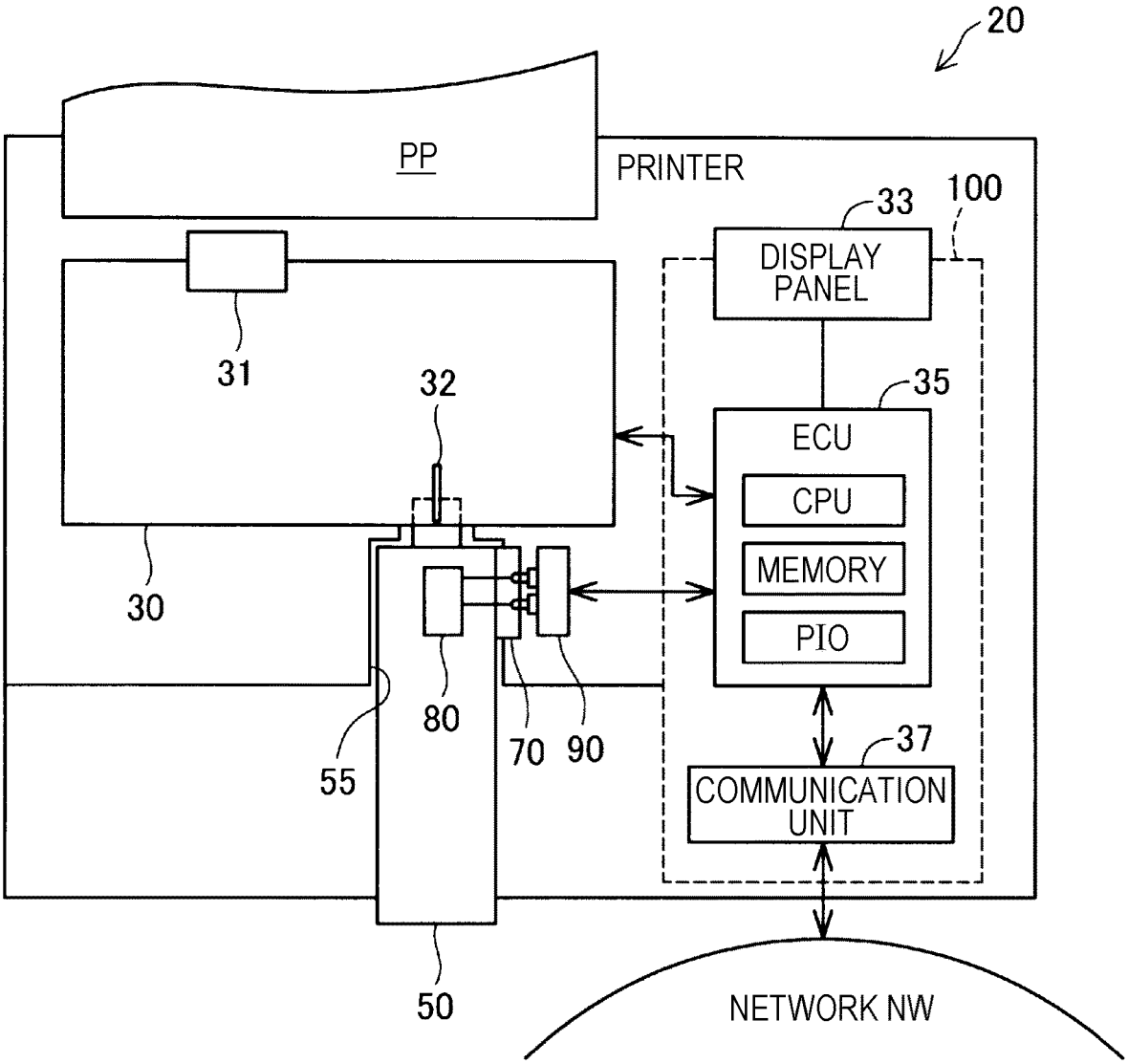
FIG. 2 is an explanatory view illustrating a mounting state of the ink cartridge of the embodiment and an outline of an internal configuration of the printer.

FIG. 1 is an external view illustrating an external appearance of a printer 20 in which ink cartridges 50 to 53 of a first embodiment are mounted. FIG. 2 is an explanatory view illustrating a configuration inside the printer 20 by representatively using the one ink cartridge 50. As illustrated in these figures, the printer 20 includes a printer body 25, and a receiving section 55 for receiving the ink cartridges 50 to 53 is provided in a lower portion thereof. The ink cartridges 50 to 53 contain inks of a plurality of colors, for example, cyan (C), magenta (M), yellow (Y), and black (K), respectively, and have the same structure. The printer 20 performs color printing by using the ink supplied from the ink cartridge 50 and the like. A paper sheet PP on which printing is performed is discharged from a discharge port 22 provided at an upper portion of the printer body 25.

When the ink cartridge 50 is inserted into the receiving section 55 and pushed all the way in, an ink supply needle 32 provided on a printer 20 side is inserted into an opening at the tip of the ink cartridge 50, and the ink contained in the ink cartridge 50 can be supplied to the printer 20 side. In this state, that is, when the ink cartridge 50 is correctly received by the receiving section 55, a cover 27 provided on a front surface of the printer body 25 can be closed. When the insertion of the ink cartridge 50 is insufficient, the cover 27 cannot be closed. The printer 20 monitors the opening and closing of the cover 27 by a sensor (not illustrated) and does not perform printing when the cover 27 is not normally closed. Therefore, the printer 20 is not used without the ink cartridge 50 being correctly received.

Inside the printer 20, in addition to the receiving section 55 that receives the ink cartridge 50 described above, a print execution unit 30 that performs printing on the paper sheet PP by using an ink head 31, a control unit 100 that controls the entirety of the printer 20, and the like are provided. The print execution unit 30 includes a mechanism for reciprocating the ink head 31 in a main scanning direction relative to the paper sheet PP, a mechanism for transporting the paper sheet PP in a sub scanning direction, a mechanism for sucking the ink from the ink cartridge 50, and a driver for driving the ink head 31 to cause the ink head 31 to eject ink droplets of the color ink onto the paper sheet PP. The configuration of the print execution unit 30 is well known, and therefore, a description thereof will be omitted.

The control unit 100 includes a display panel 33 that displays various kinds of information, an electronic control unit (also referred to as an ECU) 35 that performs control necessary for the printer, a communication unit 37 that communicates with a network NW, and the like. The ECU 35 includes a well-known CPU and memory, as well as a PIO for exchanging data with the outside. The CPU executes various programs stored in the memory, thereby implementing a function of exchanging printing instructions and data for printing with a computer or the like via the network NW by the communication unit 37, a function of allowing various settings for printing using the display panel 33, a function of exchanging information with the ink cartridge 50, a function of transmitting dot data for determining the on/off of dots to the print execution unit 30 to cause the print execution unit 30 to perform printing, and the like.

The function of exchanging information with the ink cartridge 50 out of the functions implemented by the control unit 100 is performed as follows. The ink cartridge 50 is mounted with a memory 80 for storing information in a non-volatile manner. The memory 80 is a flash ROM, and input/output of data is performed by serial communication. The memory 80 is provided with a line for transmitting electric power and a line for transferring data in and out by serial communication. In FIG. 2, these lines are drawn with two lines, but in practice, a large number of lines are coupled including a clock and the like when synchronous communication is performed. These lines are coupled to pogo pins of a coupling protrusion 70, which will be described later, and by the pogo pins coupling to an electrode holder 90 provided on the receiving section 55 side, the memory 80 and the control unit 100 are electrically coupled. The electrical coupling between the memory 80 and the control unit 100, which is enabled by the ink cartridge 50 being received, will be described later in detail.

The ink cartridge 50 which is received in the receiving section 55 of the printer 20 contains liquid ink. When the ink supply needle 32 is inserted into the opening of the ink cartridge 50, the ink contained in the ink cartridge 50 can be supplied to the printer body 25 side. This is because a valve mechanism 60 provided inside the ink cartridge 50 is brought into an opening state by the ink supply needle 32. This mechanism will be described next.

Figure 3:
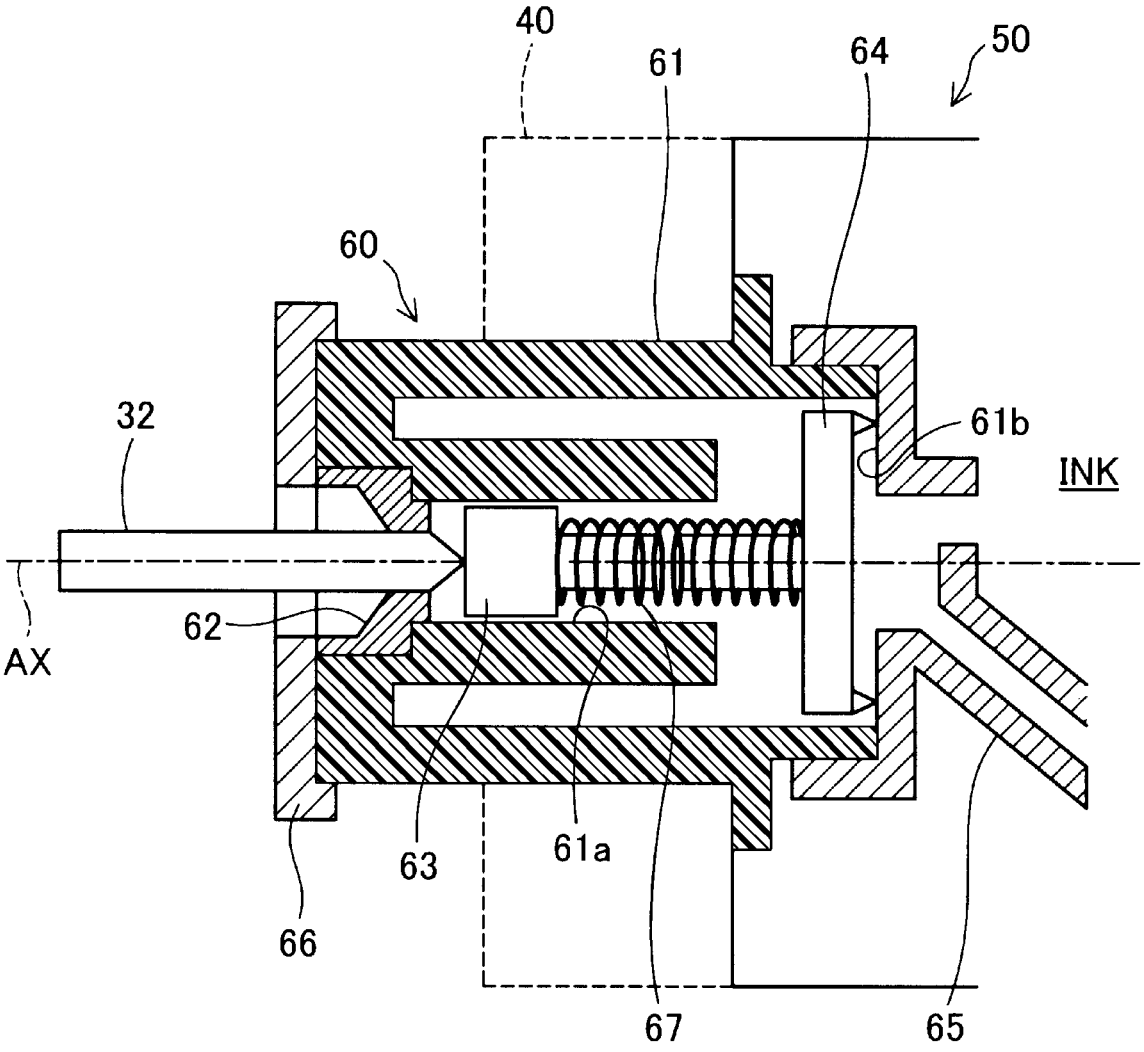
FIG. 3 is a sectional view illustrating a valve mechanism of an ink cartridge according to a first embodiment.

FIG. 3 is a sectional view illustrating a schematic configuration of the valve mechanism 60 provided inside the tip portion of the ink cartridge 50. As illustrated in the figure, the valve mechanism 60 includes a valve mechanism case 61, a seal member 62, a first valve body 63, a second valve body 64, an ink supply path 65, a cap 66, a spring 67, and the like. The seal member 62 is mounted in an opening formed by the valve mechanism case 61 made of a resin, functions as a valve seat for the first valve body 63, and is a member for closely contacting an outer periphery of the ink supply needle 32 and sealing when the ink supply needle 32 is inserted thereinto. Each of the seal member 62, the first valve body 63, and the second valve body 64 is formed using a silicon rubber. These members may be formed using other synthetic resin or rubber as long as the desired sealing properties can be implemented. In addition, the members each may be made of the same material or different materials.

The first valve body 63, the second valve body 64, and the spring 67 are housed in a flow path 61*a* formed in the valve mechanism case 61, and the first valve body 63 and the second valve body 64 are disposed so as to be biased in opposite directions from each other by the spring 67. The flow path 61*a* for housing the first valve body 63, the spring 67, and the second valve body 64 is formed along an axis AX of the ink supply needle 32 which is inserted into the opening. The first valve body 63, the second valve body 64, and the spring 67 are disposed substantially concentric with the axis AX. When the ink cartridge 50 is stored alone, the first valve body 63 is biased by the spring 67 and abuts the seal member 62 to maintain a valve closed state. On the other hand, the second valve body 64 is also biased by the spring 67 but a biased direction thereof is opposite to a biased direction of the first valve body 63, and is pressed against an end surface 61*b* formed by the ink supply path 65, thereby maintaining the closed state. In each of the first valve body 63 and the second valve body 64, a shaft body that is smaller than an inner diameter of the spring 67 is formed on a side on which the spring 67 is mounted, for positioning of the spring 67. End portions of the spring 67 are loosely fitted to the shaft bodies of the first valve body 63 and the second valve body 64.

In FIG. 3, the ink supply needle 32 is inserted inside from an inlet of the opening, and the first valve body 63 of the valve mechanism 60 is opened. In this state, the flow path 61*a* and the ink supply needle 32 communicate with each other, but the second valve body 64 is pressed against the end surface 61*b* by the spring 67 interposed between the first valve body 63 and the second valve body 64. Therefore, the second valve body 64 is maintained in the closed state. As illustrated in FIG. 2, when the ink cartridge 50 is correctly received by the receiving section 55 and the memory 80 is electrically coupled to the control unit 100, the control unit 100 of the printer 20 can recognize the memory 80 inside the ink cartridge 50, determines that the ink cartridge 50 is normally received, and instructs the print execution unit 30 to suck ink. An ink supply path (not illustrated) is formed in a center of the ink supply needle 32, and when the print execution unit 30 sucks the ink, the flow path 61*a* becomes a negative pressure, the second valve body 64 separates from the end surface 61*b*, and the second valve body 64 also becomes the opening state. When the first valve body 63 and the second valve body 64 are in the opening state, the ink in the ink cartridge 50 flows into the flow path 61*a* through the ink supply path 65, and finally passes through the ink supply needle 32 and is supplied to the printer 20 side.

2. Configuration and Movement of Electronic Component Mounting Section

Figure 4:
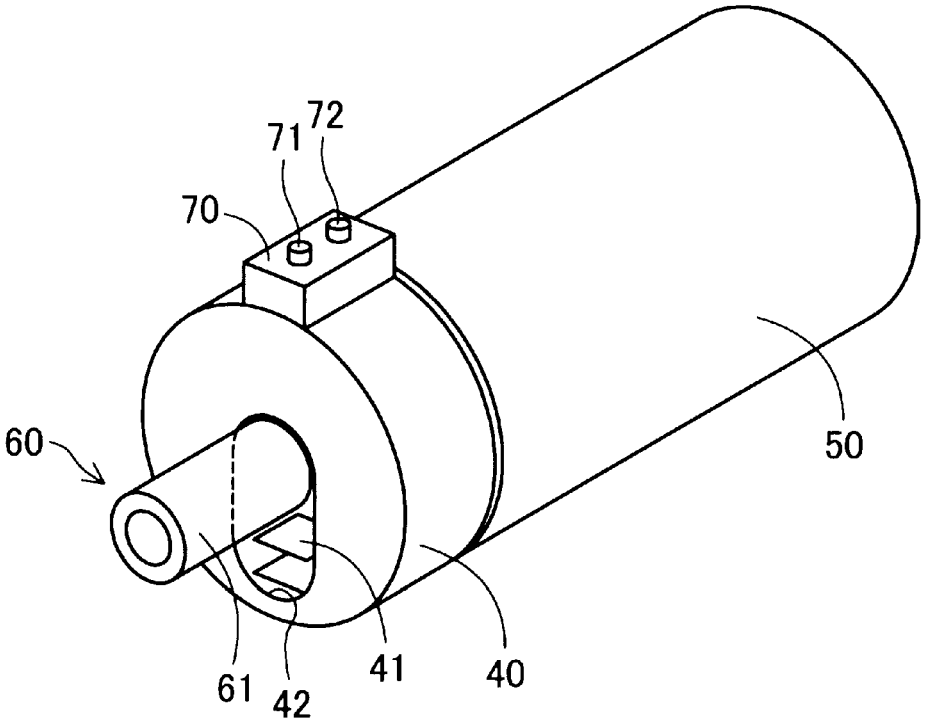
FIG. 4 is a perspective view illustrating a schematic configuration of the ink cartridge.
Figure 5:
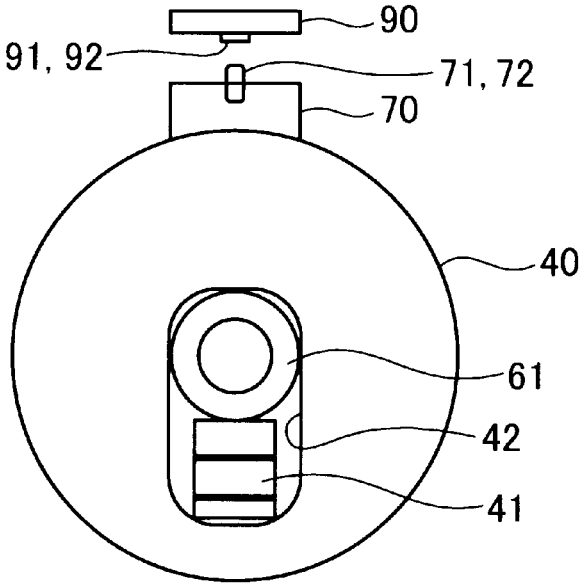
FIG. 5 is an explanatory view illustrating a relationship between a coupling protrusion of the ink cartridge and an electrode holder in front view of the ink cartridge.

As illustrated by a phantom line in FIG. 3, an electronic component mounting section 40 is provided so as to surround the valve mechanism case 61 of the valve mechanism 60. FIG. 4 is an external view of the ink cartridge 50 including the electronic component mounting section 40. In the ink cartridge 50, the electronic component mounting section 40 is incorporated outside the valve mechanism 60 on a side on which the valve mechanism 60 is provided, that is, on a side from which the ink cartridge 50 is inserted. The electronic component mounting section 40 includes an opening 42 for housing the valve mechanism case 61 inside, and the coupling protrusion 70 outside, respectively, as illustrated in FIG. 5, in which the ink cartridge 50 is viewed from the opening side of the valve mechanism 60, that is, a front view, and FIG. 6, which is a side view.

Figure 6:
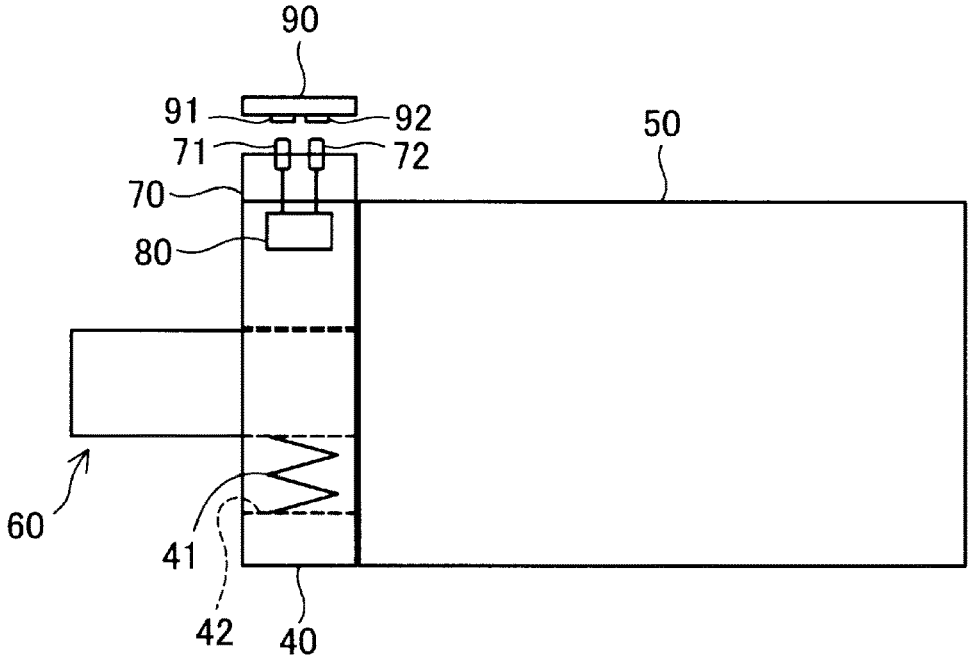
FIG. 6 is an explanatory view illustrating the relationship between the coupling protrusion of the ink cartridge and the electrode holder in side view of the ink cartridge.

The opening 42 has an oval shape when viewed in section that intersects the axis AX, a minor axis thereof is slightly larger than an outer diameter of the valve mechanism case 61, and a major axis thereof is about two times the outer diameter of the valve mechanism case 61. A leaf spring 41 is disposed below the valve mechanism case 61 in the opening 42. The leaf spring 41 serves as a holding portion that holds the electronic component mounting section 40 at a predetermined position. That is, the leaf spring 41 is disposed between a lower side of the valve mechanism case 61 and a lower end in a longitudinal direction of the opening 42 of the electronic component mounting section 40 in a slightly compressed state, and holds the electronic component mounting section 40 in a state concentric with the axis AX. Note that, since both ends of the leaf spring 41 are respectively fixed to the valve mechanism case 61 and the electronic component mounting section 40, the movement of the electronic component mounting section 40 in the axis AX direction is also restricted. FIGS. 5 and 6 illustrate a position of the electronic component mounting section 40 when the ink cartridge 50 is not mounted in the receiving section 55, that is, when the ink cartridge 50 is alone. This position is also referred to as an initial position of the electronic component mounting section 40.

At the initial position, the center of the electronic component mounting section 40 coincides with the center of the ink cartridge 50. In this state, the coupling protrusion 70 provided on an outer periphery of the electronic component mounting section 40 protrudes outside the outer periphery of the ink cartridge 50. Since the receiving section 55 includes a recess corresponding to the coupling protrusion 70 at an inlet portion thereof (see FIG. 1), by aligning the coupling protrusion 70 of the ink cartridge 50 with the recess, the ink cartridge 50 is positioned and the ink cartridge 50 is inserted into the receiving section 55. That is, the coupling protrusion 70 functions as a positioning member.

A plurality of pogo pins 71 and 72 as coupling bodies are provided on a surface of the coupling protrusion 70. The lines drawn out from the memory 80 are coupled to the pogo pins 71 and 72. The pogo pins 71 and 72, which are couplings for electrical coupling, are pins that have springs inside and are retractable in an axial direction of the pins. The pogo pins 71 and 72 of the coupling protrusion 70 are finally coupled to electrodes 91 and 92 of the electrode holder 90.

The electrodes 91 and 92 of the electrode holder 90 correspond to electrical coupling portions. The electrodes 91 and 92 are electrode plates of which surfaces are gold-plated, and are provided at positions where tips of the pogo pins 71 and 72 of the coupling protrusion 70 disposed above the electronic component mounting section 40 come into contact therewith, respectively, when the electronic component mounting section 40 is moved. In FIGS. 5 and 6, the electrode holder 90 is drawn at a position facing the coupling protrusion 70 of the electronic component mounting section 40. Since, in the figures, the electronic component mounting section 40 is not moved, the pogo pins 71 and 72 and the electrodes 91 and 92 of the electrode holder 90 are not coupled. When the ink cartridge 50 is actually mounted in the receiving section 55, the pogo pins 71 and 72 and the electrodes 91 and 92 are electrically coupled by the movement of the electronic component mounting section 40. The position of the electrode holder 90 is determined in consideration of a clearance in the arrangement with the coupling protrusion 70. Normally, the pogo pins 71 and 72 that have come into contact with the electrodes 91 and 92 slightly sink, and are biased outward by the elastic force of the springs provided inside to maintain contact with the electrodes 91 and 92.

Figure 7:
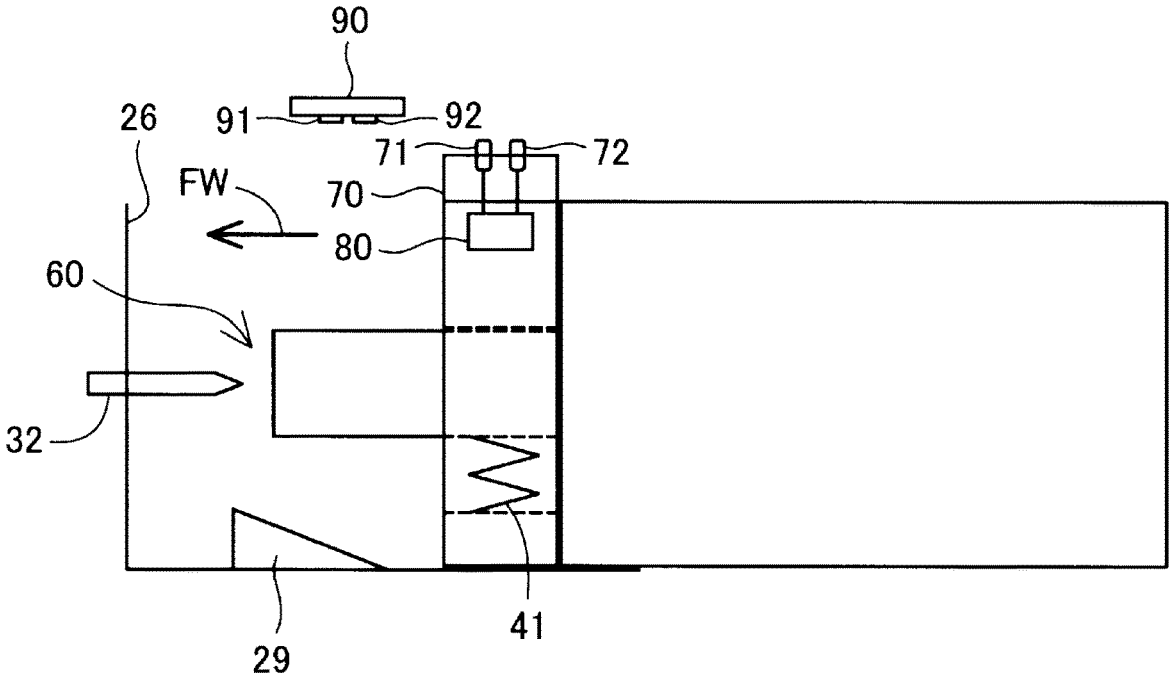
FIG. 7 is an explanatory view illustrating a state before the ink cartridge is mounted.
Figure 8:
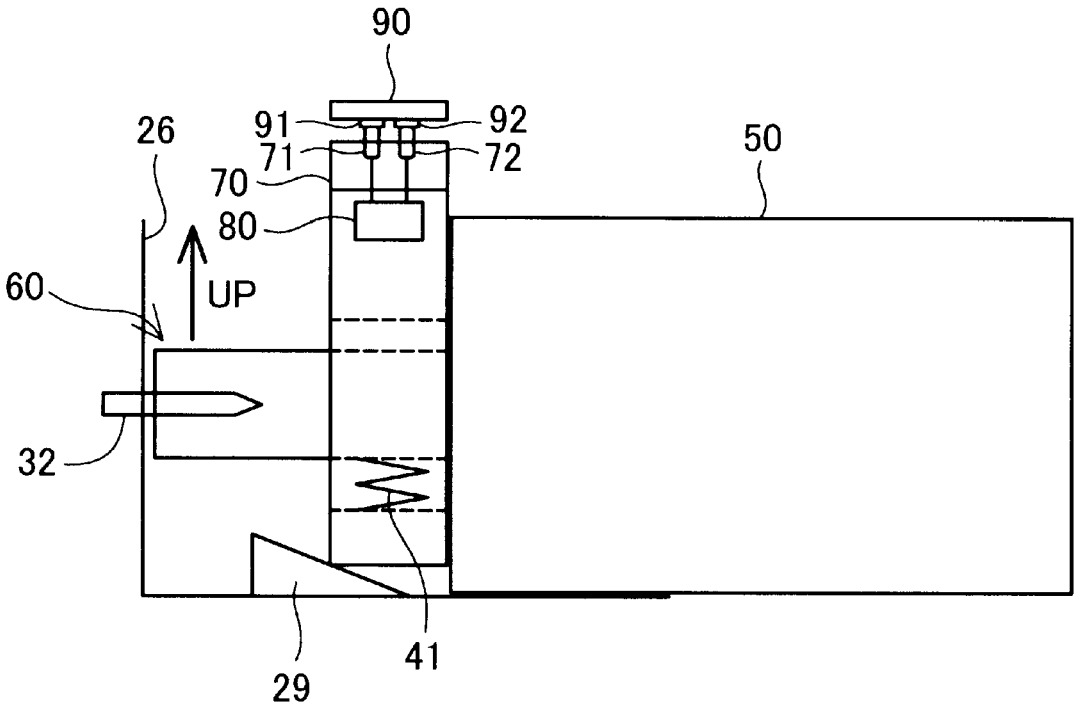
FIG. 8 is an explanatory view illustrating a state in which the ink cartridge is mounted.

The mounting of the ink cartridge 50 of the present embodiment will be described. FIG. 7 is an explanatory view illustrating a state in which the ink cartridge 50 is inserted into the receiving section 55 and immediately before the ink supply needle 32 is inserted into the opening of the valve mechanism 60. FIG. 8 is an explanatory view illustrating a state in which the ink supply needle 32 is inserted in the ink cartridge 50. As illustrated in the figures, the ink supply needle 32 is provided on a mounting wall 26 of the receiving section 55 of the printer body 25. In front of the mounting wall 26, when viewed in section in a vertical plane including the axis AX, a guide protrusion 29 having a substantially triangular shape contacts a lower end of the electronic component mounting section 40, and the electronic component mounting section 40 is moved by being guided by the guide protrusion 29. The guide protrusion 29 functions as a moving portion.

When the ink cartridge 50 is further inserted from a state in which the ink cartridge 50 is inserted into the receiving section 55, and the tip end of the electronic component mounting section 40 of the ink cartridge 50 contacts the guide protrusion 29, with the movement of the ink cartridge 50 in a first direction FW, which is a direction toward the ink supply needle 32, the electronic component mounting section 40 moves along a slope of the guide protrusion 29 in a second direction different from the first direction FW, that is, in an upward direction UP. With the movement in the second direction UP, a distance between the lower end of the opening 42 of the electronic component mounting section 40 and the lower side of the valve mechanism case 61 of the valve mechanism 60 is reduced, and the leaf spring 41 housed therein is compressed. When the ink cartridge 50 is inserted toward the ink supply needle 32 side, that is, in the first direction FW illustrated in FIG. 7, the electronic component mounting section 40 moves in the second direction UP, and the coupling protrusion 70 approaches the electrode holder 90.

Figure 9:
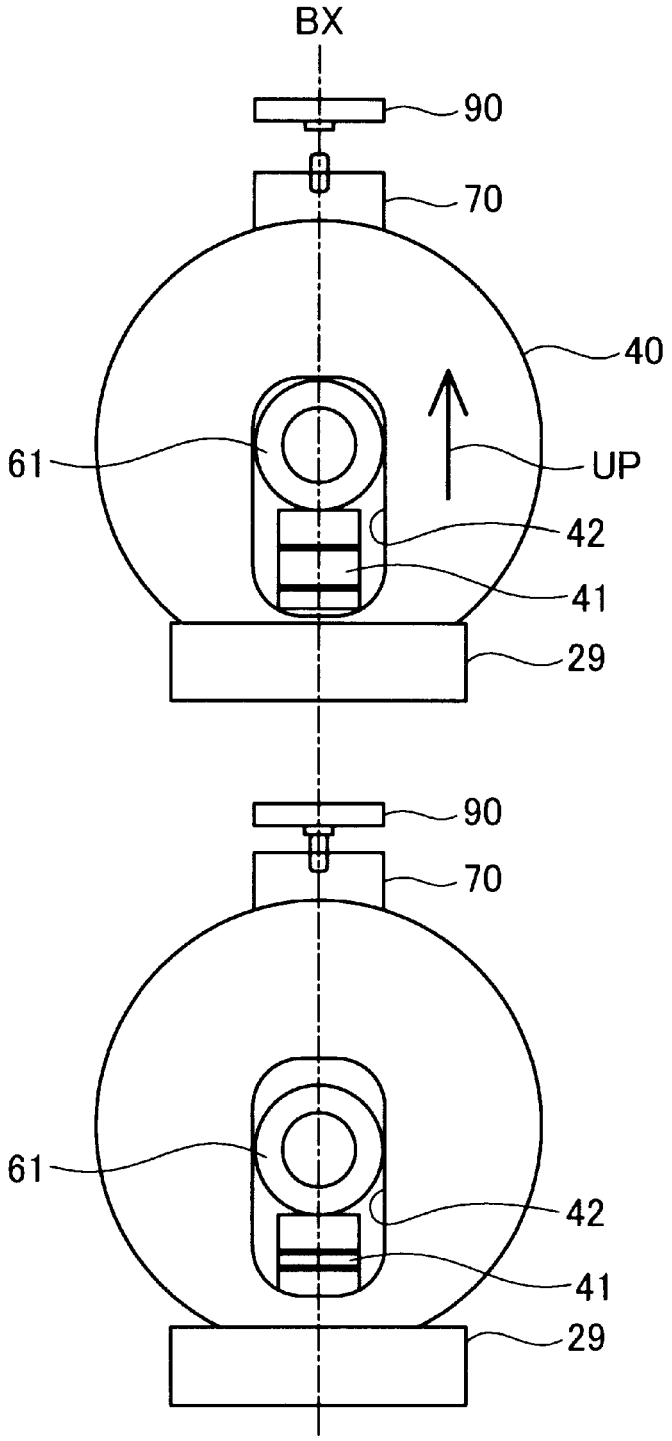
FIG. 9 is an explanatory front view illustrating a state in which the ink cartridge is mounted.

This state is illustrated in FIG. 9. An upper part of FIG. 9 illustrates a state at the time when the electronic component mounting section 40 approaches the guide protrusion 29. At this time, the electronic component mounting section 40 remains in a position substantially concentric with the ink cartridge 50, and the coupling protrusion 70 is separated from the electrode holder 90. When the ink cartridge 50 is further pushed, the electronic component mounting section 40 rides on the guide protrusion 29 and starts to move in the upward direction UP along an axis BX in an up-down direction. By this movement, the leaf spring 41 is compressed as illustrated in a lower part of FIG. 9. As a result, the coupling protrusion 70 approaches the electrode holder 90, and finally the pogo pins 71 and 72 of the coupling protrusion 70 abut the electrodes 91 and 92 of the electrode holder 90, and the electrical coupling is completed. In response to an instruction from the control unit 100 of the printer 20 triggered by this coupling, the print execution unit 30 starts to suck ink, and the ink contained in the ink cartridge 50 is supplied to the print execution unit 30 by a necessary amount.

According to the first embodiment described above, only by linearly inserting the ink cartridge 50 into the receiving section 55 along the first direction FW, the supply of ink to the ink supply needle 32 and the electrical coupling to the memory 80, which is an electronic component mounted on the electronic component mounting section 40, can be completed. Therefore, it is not necessary to rotate the ink cartridge 50 after the ink cartridge 50 is linearly pushed into the receiving section 55. For this reason, the ink cartridge 50 is easily mounted, and an error such as insufficient electrical coupling is unlikely to occur. Further, the ink cartridge 50 can be removed by simply pulling out the ink cartridge 50 as it is. Therefore, unlike an ink cartridge that is pulled out after being rotated, there is less risk of accidentally damaging the ink cartridge 50 when trying to pull out the ink cartridge 50 without rotating.

Further, in the ink cartridge 50, since the electronic component mounting section 40 is held at the initial position by the leaf spring 41 in the ink cartridge 50 alone, it is not necessary to adjust the position of the electronic component mounting section 40 to the initial position when the ink cartridge 50 is mounted in the receiving section 55. Also, the problem that the position of the electronic component mounting section 40 is shifted and the ink cartridge 50 cannot be inserted into the receiving section 55 does not occur. Further, in the ink cartridge 50 of the first embodiment, the pogo pins 71 and 72 are used at the electrical coupling portions of the coupling protrusion 70. Therefore, when the pogo pins 71 and 72 abut the electrodes 91 and 92 of the electrode holder 90, the pogo pins 71 and 72 are retracted, so that it is possible to easily assure clearances therebetween.

In the embodiment described above, the coupling protrusion 70 and the pogo pins 71 and 72 thereof are provided at the upper end of the electronic component mounting section 40, but the coupling protrusion 70 may be provided at a side portion of the electronic component mounting section 40. In this case, the electrode holder 90 may be provided at a position corresponding to the coupling protrusion 70 when the electronic component mounting section 40 is moved in the second direction, and the pogo pins 71 and 72 may be slid in a lateral direction to come into contact with the electrodes 91 and 92. The pogo pins 71 and 72 may be provided on an upper surface of the coupling protrusion 70 protruding toward the side of the electronic component mounting section 40, and the electrodes 91 and 92 of the electrode holder 90 may be provided so as to be separated in the second direction when viewed from the coupling protrusion 70, similar to the first embodiment described above.

In the first embodiment, as illustrated in FIG. 8, since the guide protrusion 29 has a triangular shape in side view, the section cut in the plane perpendicular to the axis AX has a rectangular shape as illustrated in FIG. 9. The shape of the guide protrusion is not limited to this, and the shape in sectional view may be an arc shape matched to an outer shape of the electronic component mounting section 40. Alternatively, instead of the triangular shape in side view, the guide protrusion 29 may have a shape in which a height monotonically increases in a curve, or may have a trapezoidal shape or the like that is capable of moving the electronic component mounting section 40 to a predetermined height in the second direction and then further moving the electronic component mounting section 40 in the first direction. Further, since the leaf spring 41 is fixed to the lower side of the valve mechanism case 61 and the lower end of the opening 42 of the electronic component mounting section 40, the electronic component mounting section 40 can be held not only at the initial position in the direction orthogonal to the axis AX but also at the initial position in the axis AX direction.

B. Second Embodiment

Figure 10:
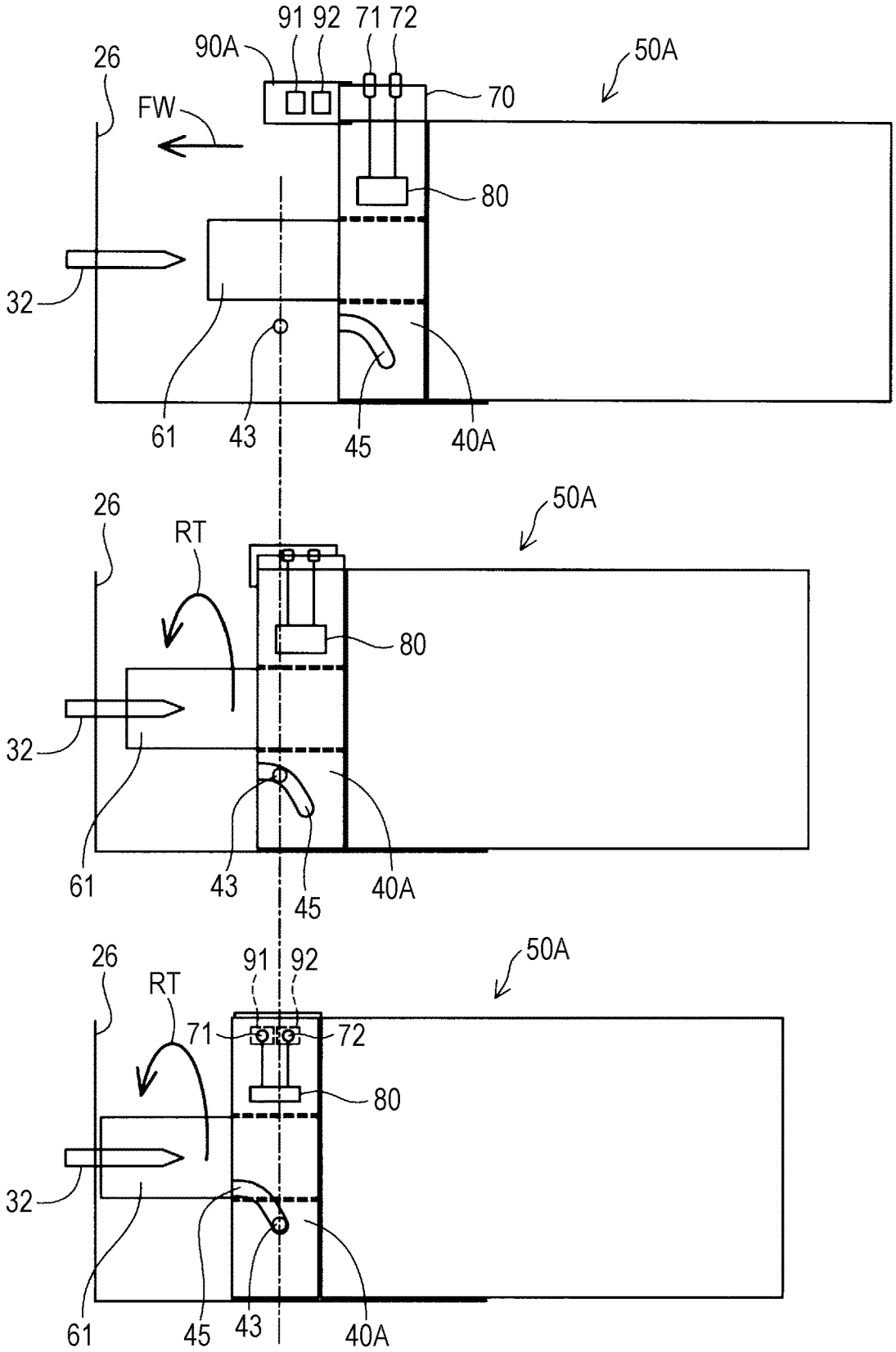
FIG. 10 is an explanatory side view illustrating a state in which an ink cartridge of a second embodiment is mounted.
Figure 11:
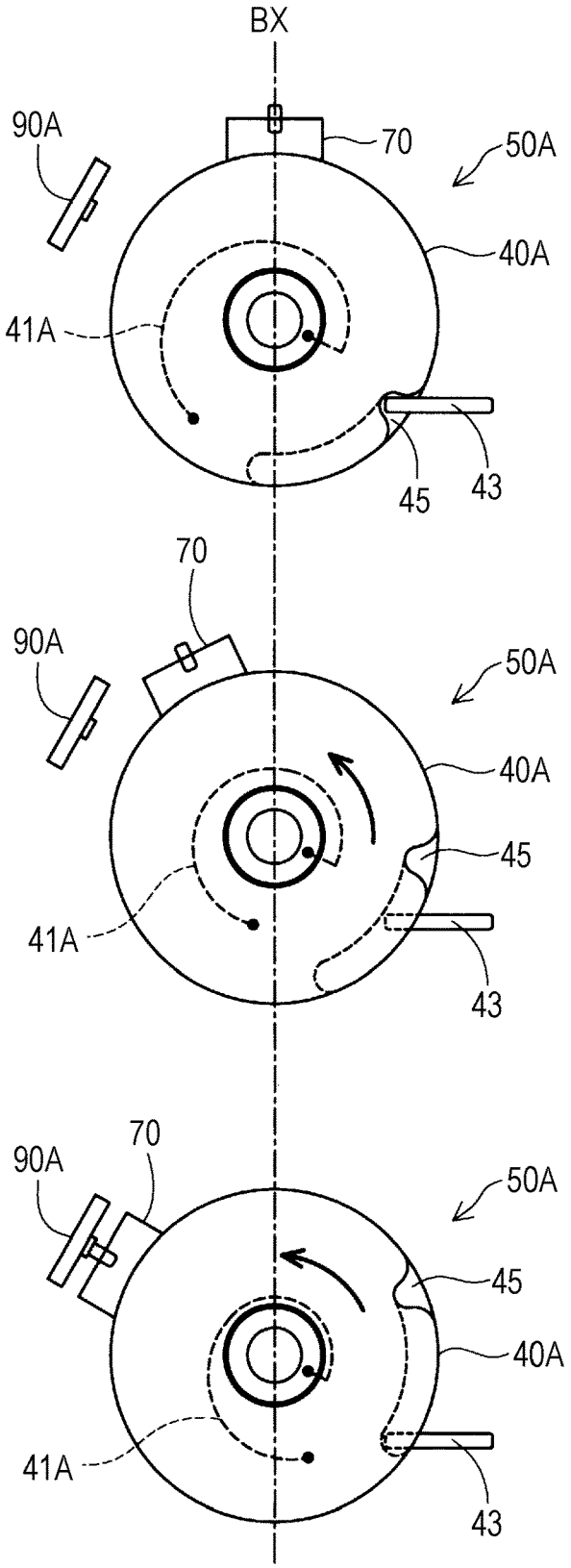
FIG. 11 is an explanatory front view illustrating the state in which the ink cartridge of the second embodiment is mounted.

Next, a second embodiment will be described. As illustrated in FIGS. 10 and 11, an ink cartridge 50A of the second embodiment includes an electronic component mounting section 40A. The electronic component mounting section 40A is similar to the electronic component mounting section 40 of the first embodiment in that the electronic component mounting section 40A includes the memory 80 and the coupling protrusion 70, but is different from the electronic component mounting section 40 of the first embodiment in that the electronic component mounting section 40A is rotationally moved in a second direction RT around the axis AX as a rotation center by the movement of the ink cartridge 50A in the first direction FW. In order to achieve such movement, in the ink cartridge 50A of the second embodiment, a spiral groove 45, which is an engaged portion, is provided on an outer periphery of the electronic component mounting section 40A. Correspondingly, the receiving section 55 for receiving the ink cartridge 50A is provided with an engaging pin 43 protruding from a side surface of the mounting wall 26 as an engaging portion.

In the second embodiment, an electrode holder 90A that makes electrical coupling by contacting the pogo pins 71 and 72 of the coupling protrusion 70 is not located in the upper part along the axis BX in the up-down direction, and is disposed at a position rotated by about 60 degrees from the axis BX. Further, a helical spring 41A is provided between an outer periphery of the valve mechanism 60 and the electronic component mounting section 40A. For the helical spring 41A, a state illustrated in the uppermost part of FIG. 11, that is, a state in which the coupling protrusion 70 in the electronic component mounting section 40A is disposed at the highest position along the axis BX and an entrance of the spiral groove 45 is at the same height as the engaging pin 43, is a default state. The helical spring 41A holds the electronic component mounting section 40A in this state.

The uppermost part of FIG. 10 illustrates a state in which the ink cartridge 50A is inserted into the receiving section 55 and the spiral groove 45 of the electronic component mounting section 40A has not reached the engaging pin 43 yet. When the ink cartridge 50A is inserted in the first direction FW as it is, the ink supply needle 32 is inserted into the opening of the valve mechanism 60, and further, the engaging pin 43 engages with the spiral groove 45 of the electronic component mounting section 40A, as illustrated in a middle part of FIG. 10. The spiral groove 45 is formed in a shape forming a part of a downward spiral shape on the outer periphery of the electronic component mounting section 40A. When the ink cartridge 50A is inserted in the first direction, the electronic component mounting section 40A is rotationally moved in the second direction RT because the position in the height direction is restricted by the engaging pin 43. This state is illustrated in the bottom part of FIG. 10.

When the electronic component mounting section 40A is rotationally moved in the second direction RT with the movement of the ink cartridge 50A in the first direction FW in this way, the coupling protrusion 70 approaches the electrode holder 90A accordingly. In a state in which the electronic component mounting section 40A is rotated by 60 degrees (the bottom part of FIG. 11), the pogo pins 71 and 72 of the coupling protrusion 70 abut the electrodes 91 and 92 of the electrode holder 90A to be electrically coupled thereto, respectively. As a result, data can be exchanged between the control unit 100 and the memory 80, and ink suction and the like can be performed, as in the first embodiment.

As illustrated in FIG. 11, since the helical spring 41A is tightened with the rotation of the electronic component mounting section 40A, the electronic component mounting section 40A is in a state of receiving the force directed toward the initial position by the helical spring 41A. Thus, when the ink cartridge 50A is linearly pulled out in the direction opposite to the first direction FW in order to remove the ink cartridge 50A, the electronic component mounting section 40A is rotationally moved in the direction opposite to the second direction RT due to the engagement between the spiral groove 45 and the engaging pin 43. When the engagement between the two is released, the electronic component mounting section 40A is held at the initial position by the helical spring 41A.

According to the ink cartridge 50A of the second embodiment described above, the effect similar to that of the first embodiment is obtained, and the second direction RT is the rotation direction about the axis AX, so that the pogo pins 71 and 72 of the coupling protrusion 70 and the electrodes 91 and 92 of the electrode holder 90A are brought into contact with each other in a sliding direction. Thus, even when the rotational movement of the coupling protrusion 70 varies, it is unlikely that the pogo pins 71 and 72 of the coupling protrusion 70 strongly hit the electrodes 91 and 92 of the electrode holder 90A and are damaged, or that, conversely, the pogo pins 71 and 72 of the coupling protrusion 70 do not reach the electrodes 91 and 92 of the electrode holder 90A, and the electrical coupling cannot be established.

In the second embodiment described above, the second direction is the rotational direction about the axis AX, and the pogo pins 71 and 72 on the coupling protrusion 70 that rotates are configured to laterally slide and contact the electrodes 91 and 92. However, the pogo pins 71 and 72 and the electrodes 91 and 92 may be designed so that the pogo pins 71 and 72 are provided on a left side surface of the coupling protrusion 70, and that, when the coupling protrusion 70 is rotated, the pogo pins 71 and 72 on the side surface of the rotated coupling protrusion 70 abut the electrodes 91 and 92, as in the first embodiment.

C. For Various Variants

In each of the embodiments described above, the memory that stores information about the ink cartridge is used as the electronic component, but an electronic component other than the memory may be used. For example, it is possible to employ, as the electronic circuit, a sensor for detecting the amount of ink remaining in the ink cartridge, an IC for communication with the printer body, an RFID that combines the memory function and the function to authenticate the ink cartridge and the like, and further, an electronic circuit that returns a specific response in accordance with an electric signal from the printer body side, and the like.

In the embodiments described above, the electrical coupling is made by the pogo pins 71 and 72 serving as the coupling bodies and the electrodes 91 and 92 serving as the electrical coupling portions. However, the electrical contacts may not be movable contacts such as the pogo pins 71 and 72, but may be fixed contacts. In this case, the clearance may be secured by providing the electrodes 91 and 92 of the electrode holder 90 obliquely to the movement of the electronic component mounting section 40 in the second direction. Alternatively, an RFID or the like may be used to achieve non-contact electrical coupling with an electronic component.

The first direction and the second direction in the electronic component mounting section are the axis AX direction and an up-down direction orthogonal to this axis in the first embodiment, and the axis AX direction and the rotation direction about this axis in the second embodiment, but the first direction and the second direction may be a combination of other directions. For example, the axis AX direction and a right-left direction orthogonal to this axis may be used. In this case, when a guide protrusion is provided, the second direction can be an up-down direction or right-left direction that is not orthogonal to the axis AX. In addition, the first direction and the second direction may be the axis AX direction and a rotation direction about another axis parallel to the axis AX. In any case, it is sufficient that both of the directions be different from each other.

D. Other Aspects

Although some embodiments have been described above, the present disclosure is not limited to these embodiments, and may be implemented in various aspects. For example, as an ink cartridge mounted in a printer, the following aspects are also possible. The ink cartridge includes a cartridge body configured to contain ink to be supplied to the printer, including a guide portion having a shape that fits into a cartridge receiving section provided on a printer side, and configured to be linearly inserted to a first position in which the ink cartridge is in a mounted state in the cartridge receiving section, an electronic component mounting section configured to mount an electronic component, and configured to move with respect to the cartridge body in a second direction different from a first direction that is a direction in which the ink cartridge is inserted into the cartridge receiving section, a holding portion configured to hold the electronic component mounting section at an initial position in which the electronic component mounting section is in a predetermined positional relationship with the cartridge body when the cartridge body is not inserted into the cartridge receiving section, and a moving portion, by the cartridge body being inserted in the first direction from a second position before the first position in the cartridge receiving section of the printer, configured to move the electronic component mounting section in the second direction from the initial position to couple the electronic component to electrical coupling portions provided on the printer side.

According to the ink cartridge of this aspect, only by linearly inserting the cartridge body in the first direction from the second position before the first position in which the cartridge body is in the mounted state, the electronic component mounting section is moved in the second direction from the initial position so that the electronic component mounted on the electronic component mounting section can be coupled to the electrical coupling portions provided on the printer side. Therefore, the ink cartridge can be mounted and the electronic component can be electrically coupled only by linearly inserting the ink cartridge body into the receiving section. Such an ink cartridge may contain liquid ink, or powder ink such as toner.

In such an ink cartridge, the electronic component mounting section may be configured to move with respect to the cartridge body in the second direction from the initial position, and the moving portion may be a guide protrusion provided on an inner surface of the cartridge receiving section of the printer and configured to move the electronic component mounting section in the second direction from the initial position when the electronic component mounting section rides on the guide protrusion. In this configuration, the moving portion can be easily achieved.

In such an ink cartridge, the electronic component mounting section may be configured to rotate with respect to the cartridge body in the second direction from the initial position with the first direction as an axial direction of a rotation axis, and the moving portion may include an engaged portion that engages with an engaging portion provided along the second direction on an inner surface of the cartridge receiving section of the printer, and may rotationally move the electronic component mounting section in the second direction from the initial position by the cartridge body being inserted in the first direction from the second position. In this configuration, the movement in the second direction can be the rotational movement.

In such an ink cartridge, the holding portion may be an elastic body configured to bias the electronic component mounting section toward the initial position. In this configuration, the electronic component mounting section can be easily held.

As another aspect, an aspect as a printer including a printer body and an ink cartridge which is mounted in the printer body is also possible. The printer body of the printer may include a cartridge receiving section for receiving the ink cartridge, an engaging portion formed on an inner surface of the cartridge receiving section, electrical coupling portions provided on the inner surface of the cartridge receiving section, and an electronic circuit coupled to the electrical coupling portions. On the other hand, the ink cartridge may include a cartridge body configured to contain ink to be supplied to the printer body, including a guide portion having a shape that fits into the cartridge receiving section of the printer body, and configured to be linearly inserted to a first position in which the ink cartridge is in a mounted state in the cartridge receiving section, an electronic component mounting section configured to mount an electronic component, and configured to move with respect to the cartridge body in a second direction different from a first direction that is a direction in which the ink cartridge is inserted into the cartridge receiving section, a holding portion configured to hold the electronic component mounting section at an initial position in which the electronic component mounting section is in a predetermined positional relationship with the cartridge body when the cartridge body is not inserted into the cartridge receiving section, an engaged portion provided on an outer periphery of the cartridge body, and configured to move the electronic component mounting section in the second direction from the initial position by engaging with the engaging portion of the printer body and by the cartridge body being inserted in the first direction from a second position before the first position in the cartridge receiving section of the printer body, and coupling bodies configured to couple the electronic component to the electronic circuit of the printer body by coupling to the electrical coupling portions of the printer body with the movement of the electronic component mounting section in the second direction.

In this configuration, in the printer, the electronic component mounting section can be moved in the second direction and the electrical coupling can be completed only by the ink cartridge linearly being inserted into the printer body. Therefore, the ink cartridge can be easily mounted in the printer.

Further, there may be an aspect as a method for mounting, in a printer, an ink cartridge including a cartridge body containing ink and an electronic component mounting section on which an electronic component is mounted. This mounting method includes holding the electronic component mounting section at an initial position that is a predetermined position to the cartridge body in a state in which the cartridge body is not inserted in a cartridge receiving section provided on a printer side, linearly inserting, in the cartridge receiving section of the printer, the cartridge body including a guide portion having a shape that fits into the cartridge receiving section along a first direction, which is an insertion direction of the cartridge body into the cartridge receiving section, to a second position before a first position in which the cartridge body is in a mounted state in the cartridge receiving section, and moving the electronic component mounting section from the initial position in a second direction different from the first direction to couple the electronic component to electrical coupling portions provided on the printer side, by linearly inserting the cartridge body from the second position to the first position along the first direction.

By this method, the ink cartridge is easily mounted in the printer body with the electrical coupling of the electronic component mounting section.

Although the various embodiments and aspects have been described above, the present disclosure is not limited to the embodiments described above and the like, and can be implemented with various configurations within the scope that does not depart from the gist of the present disclosure. For example, the technical features of the embodiments corresponding to the technical features in each aspect described in the section of Summary can be appropriately replaced or combined in order to solve some or all of the problems described above or to achieve some or all of the effects described above. Further, the technical features that are not described as essential in this specification can be deleted as appropriate. For example, a part of the configuration achieved by hardware in the embodiments described above can be achieved by software.

What is claimed is:

1. An ink cartridge that is mounted in a printer, the ink cartridge comprising:

a cartridge body configured to contain ink to be supplied to the printer, including a guide portion having a shape that fits into a cartridge receiving section provided on a printer side, and configured to be linearly inserted to a first position in which the ink cartridge is in a mounted state in the cartridge receiving section;

an electronic component mounting section configured to mount an electronic component, and configured to move with respect to the cartridge body in a second direction different from a first direction that is a direction in which the ink cartridge is inserted into the cartridge receiving section;

a holding portion configured to hold the electronic component mounting section at an initial position in which the electronic component mounting section is in a predetermined positional relationship with the cartridge body when the cartridge body is not inserted into the cartridge receiving section; and a moving portion, by the cartridge body being inserted in the first direction from a second position before the first position in the cartridge receiving section of the printer, configured to move the electronic component mounting section in the second direction from the initial position to couple the electronic component to electrical coupling portions provided on the printer side.

2. The ink cartridge according to claim 1, wherein the electronic component mounting section is configured to move with respect to the cartridge body in the second direction from the initial position, and the moving portion is a guide protrusion provided on an inner surface of the cartridge receiving section of the printer and configured to move the electronic component mounting section in the second direction from the initial position when the electronic component mounting section rides on the guide protrusion.

3. The ink cartridge according to claim 1, wherein the electronic component mounting section is configured to rotate with respect to the cartridge body in the second direction from the initial position with the first direction as an axial direction of a rotation axis, and the moving portion includes an engaged portion that engages with an engaging portion provided along the second direction on an inner surface of the cartridge receiving section of the printer, and rotationally moves the electronic component mounting section in the second direction from the initial position by the cartridge body being inserted in the first direction from the second position.

4. The ink cartridge according to claim 1, wherein the holding portion is an elastic body configured to bias the electronic component mounting section toward the initial position.

5. A printer comprising:

a printer body; and an ink cartridge that is mounted in the printer body, wherein the printer body includes a cartridge receiving section for receiving the ink cartridge, an engaging portion formed on an inner surface of the cartridge receiving section, electrical coupling portions provided on the inner surface of the cartridge receiving section, and an electronic circuit coupled to the electrical coupling portions, and the ink cartridge includes a cartridge body configured to contain ink to be supplied to the printer body, including a guide portion having a shape that fits into the cartridge receiving section of the printer body, and configured to be linearly inserted to a first position in which the ink cartridge is in a mounted state in the cartridge receiving section, an electronic component mounting section configured to mount an electronic component, and configured to move with respect to the cartridge body in a second direction different from a first direction that is a direction in which the ink cartridge is inserted into the cartridge receiving section, a holding portion configured to hold the electronic component mounting section at an initial position in which the electronic component mounting section is in a predetermined positional relationship with the cartridge body when the cartridge body is not inserted into the cartridge receiving section, an engaged portion provided on an outer periphery of the cartridge body, and configured to move the electronic component mounting section in the second direction from the initial position by engaging with the engaging portion of the printer body and by the cartridge body being inserted in the first direction from a second position before the first position in the cartridge receiving section of the printer body, and coupling bodies configured to couple the electronic component to the electronic circuit of the printer body by coupling to the electrical coupling portions of the printer body with the movement of the electronic component mounting section in the second direction.

6. A method for mounting, in a printer, an ink cartridge including a cartridge body containing ink and an electronic component mounting section on which an electronic component is mounted, the method comprising:

holding the electronic component mounting section at an initial position that is a predetermined position to the cartridge body in a state in which the cartridge body is not inserted in a cartridge receiving section provided on a printer side;

linearly inserting, in the cartridge receiving section of the printer, the cartridge body including a guide portion having a shape that fits into the cartridge receiving section along a first direction, which is an insertion direction of the cartridge body into the cartridge receiving section, to a second position before a first position in which the cartridge body is in a mounted state in the cartridge receiving section; and moving the electronic component mounting section from the initial position in a second direction different from the first direction to couple the electronic component to electrical coupling portions provided on the printer side, by linearly inserting the cartridge body from the second position to the first position along the first direction.

* * * * *